US007048006B2

(12) United States Patent
Hurr

(10) Patent No.: US 7,048,006 B2
(45) Date of Patent: May 23, 2006

(54) MATERIAL FEEDING CONTAINER FOR TWO-CYLINDER THICK MATTER PUMPS

(75) Inventor: Hellmut Hurr, Reutlingen (DE)

(73) Assignee: Putzmeister Aktiengesellschaft, (DE)

( * ) Notice: Subject to any disclaimer, the term of this patent is extended or adjusted under 35 U.S.C. 154(b) by 182 days.

(21) Appl. No.: 10/494,182

(22) PCT Filed: Nov. 2, 2002

(86) PCT No.: PCT/EP02/12248

§ 371 (c)(1),
(2), (4) Date: Apr. 29, 2004

(87) PCT Pub. No.: WO03/042535

PCT Pub. Date: May 22, 2003

(65) Prior Publication Data

US 2004/0261869 A1 Dec. 30, 2004

(30) Foreign Application Priority Data

Nov. 14, 2001 (DE) ..... 101 55 787

(51) Int. Cl.
*F16K 11/02* (2006.01)

(52) U.S. Cl. ..... 137/874; 417/517

(58) Field of Classification Search ..... 137/874; 417/517, 519, 532

See application file for complete search history.

(56) References Cited

U.S. PATENT DOCUMENTS 4,198,193 A * 4/1980 Westerlund et al. ..... 417/517
4,382,752 A * 5/1983 Schlecht ..... 417/516
4,613,290 A * 9/1986 Evenson ..... 417/517
4,653,990 A * 3/1987 Schlecht ..... 417/517
4,979,884 A * 12/1990 Letarte et al. ..... 417/532
5,746,247 A * 5/1998 Schlecht et al. ..... 137/625.45
5,857,490 A * 1/1999 Kao ..... 137/625.45
6,443,718 B1 * 9/2002 Vincent ..... 417/518
6,857,861 B1 * 2/2005 Condon et al. ..... 417/517

* cited by examiner

*Primary Examiner*—John Fox
(74) *Attorney, Agent, or Firm*—Akerman Senterfitt; Stephan A. Pendorf

(57) ABSTRACT

The invention relates to a material feeding container for two-cylinder thick matter pumps. The material feeding container (24) has a material supply opening (30) oriented upward, two feed cylinder openings (34) arranged in the front wall (36) of the container and a transfer tube having the shape of an S-tube (42), which is arranged inside the container with its input end (48) swiveling in an alternating manner in front of the feed cylinder openings (34) and mounted on the output side in a feed-through opening (46) of the rear wall (38) of the container that is arranged above the feed cylinder openings. A pressure pipe (40) is connected to the outer side of the rear wall (38) of the container, the output side (44) of the S-pipe (42) leading into said pressure pipe. According to the invention, a maintenance opening (56) is arranged on the rear wall (38), which is formed by an opening defined by a peripheral edge (58). The maintenance opening (56) can be closed with a cover plate (60), which has a top cover plate part (64) that is oriented perpendicular to the swiveling axis (50) of the S-pipe (42) and includes the feed-through opening (46) for the S-pipe (42) and a bottom cover plate part (68) that forms an inclined bottom part and that is connected to said top part substantially parallel to an S-pipe segment (66) extending obliquely downward.

6 Claims, 4 Drawing Sheets

MATERIAL FEEDING CONTAINER FOR TWO-CYLINDER THICK MATTER PUMPS

CROSS REFERENCE TO RELATED APPLICATION

This application is a national stage of PCT/EP02/122248 filed Nov. 2, 2002 and based upon DE 101 55 787.6 filed Nov. 14, 2001 under the International Convention.

BACKGROUND OF THE INVENTION

1. Field of the Invention

The invention concerns a material feed container for two-cylinder thick matter pumps of the type described in the precharacterizing portion of claim 1.

2. Description of the Related Art

A thick matter pump of this type is known (EP-B 0 410 972), which comprises an upwardly open material receiving opening, two conveyer cylinder openings in the front container wall, preferably provided with a friction gasket, and a pipe switch which has the shape of a S-pipe, is located inside the container, on the inlet side is pivotable alternatingly in front of the conveyor cylinder openings, and at the outlet side is mounted in a through-feed opening of the container wall located above the conveyor cylinder openings and is there in communication with a pressure pipe connected from outside to the container rear wall. The cleaning and servicing of this type of container conventionally occurs from above through the opening for receiving material. Since an agitator is additionally provided in the inside of the container, the dismantling and reinstallation of the pipe switch through the material supply opening is accomplished with difficulty. In order to overcome this disadvantage, it has already been proposed to provide at the material supply container a service opening which can be closed-off via a cover plate, through which access may be had to the S-pipe. This cover plate is in the form of an agitator-equipped segment of a sidewall, such that when the cover plate is opened, the agitator pivots out of the container through the service opening. Further, it is known (DE-A 197 31 335) to provide for this purpose a rear wall which is completely removable. In this design however the stability of the material supply container suffers. Besides this, in the vicinity of the removable rear wall and below the S-pipe a dead space is formed, in which concrete can collect, which must then be removed from this dead space by supplemental measures.

SUMMARY OF THE INVENTION

Beginning therewith, it is the task of the invention to improve the known material supply containers of the above described type in such a manner that a simple servicing of the material supply container is made possible and nevertheless a stable construction is ensured and dead space inside the container is avoided.

The characterizing features set forth in Patent claim 1 are proposed as the solution of this task. Advantageous embodiments and further developments of the invention can be seen from the dependent claims.

The inventive solution is based upon the idea that the service opening is a cutout in the rear wall bordered by a circumferential edge, and that the maintenance opening can be closed with a cover plate, which has a top cover plate part that is oriented perpendicular to the swivel axis of the S-pipe and includes the feed-through opening for the S-pipe, and a bottom cover plate part that forms an inclined bottom part and is connected to said top cover plate part substantially parallel to an S-pipe segment extending obliquely downward. Therein the service opening must be sufficiently large that the S-pipe can pass through it. Although the service opening is thus relatively large, the circumferential edge ensures a sufficient shape-stability. A further improvement in this respect results when the cover plate is comprised of two cover parts oriented diagonally to each other. The lower, diagonally oriented cover plate part runs close to the slanted S-pipe segment, so that the production of a dead space, in which concrete can deposit, is substantially avoided.

An advantageous embodiment of the invention envisions that the circumferential edge of the service opening includes an upper flange apart for flush attachment of the upper lid part, which extends over a plane oriented perpendicular to the pivot axis, and which joins downwards a lower flange part for flush attachment of the lower cover part, which is oriented along a plane which runs substantially parallel to the diagonal or inclined section of the S-pipe segment.

Preferably, elements for the releasable securing of the conveyor pipe are provided on the outside of the upper cover plate part on the sides next to the through-feed hole. This includes a pivot bearing via which the conveyor pipe is pivotable about the vertical axis relative to the through hole, as well as a screw borehole or a securing bolt for fixing the conveyor pipe pivoted into place in front of the through-feed hole.

BRIEF DESCRIPTION OF THE DRAWING

In the following the invention will be described in greater detail on the basis of an illustrative embodiment shown in schematic manner in the figures. There is shown FIG. 1 a side view of a mobile concrete pump with rearward material supply container.

DETAILED DESCRIPTION OF THE INVENTION

Figure 1:
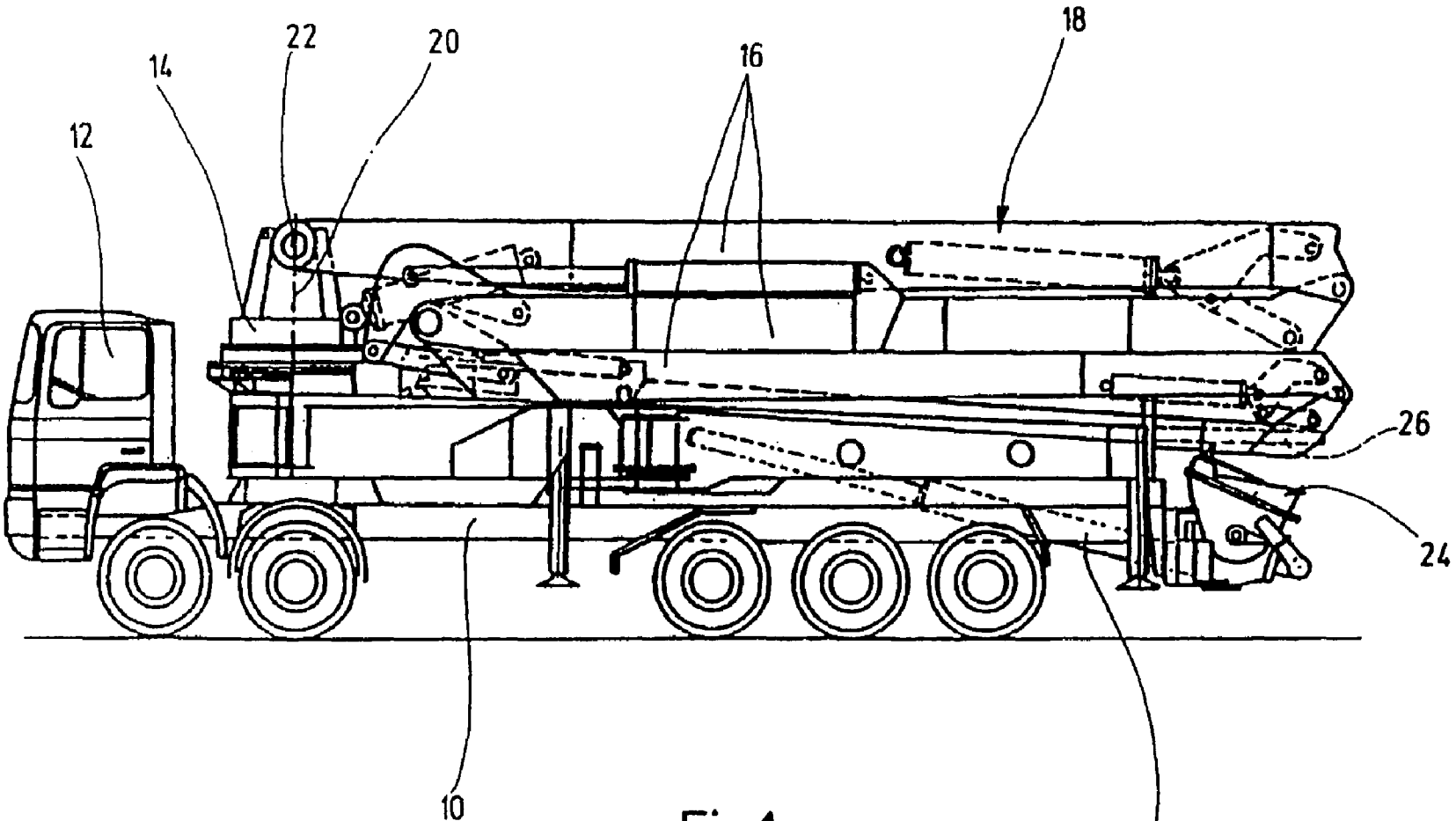

The mobile concrete pump is comprised essentially of an undercarriage 10 in the form of a truck chassis with driver cab 12, with a mast block or base block 14 provided in the forward part of the undercarriage 10, to which a distribution boom 18 is connected comprised of multiple foldable boom arms 16 rotatable about a vertical axis 20 and pivotable about a horizontal axis 22, a material supply container 24 located in the vicinity of the rearward end of the vehicle undercarriage 10 and a concrete pump 28 connected on the suction side with the material supply container 24 and on the pressure side with a conveyor line 26 extending along the distribution boom 18. The material supply container 24 includes a diagonally upward oriented material intake opening 30 covered with a grate 29, which is bordered by a flange-like opening 32.

The material supply container 24 is a component of a two-cylinder thick matter pump 28, wherein the conveyor cylinders 31 are in communication with the material supply container 24 via container cylinder openings 34 in the front wall 36. On the rear wall 38 of the material supply container, lying opposite to the front wall 36, a pressure pipe 40 is connectable from outside, to which the conveyor line 26 is connected. Inside the container there is a pipe switch in the form of an S-shaped pipe 42, which at its outlet end 44 is mounted in the area of a through-feed hole 46 located in the area of the rear wall 38, and of which the inlet end 48 is pivotable with the aid of a hydraulic cylinder 53 about the axis 50 of the pivot shaft 52 so as to be alternatingly in front of the two conveyor cylinder openings 34. The S-pipe 42 carries on its inlet end 48 a closure ring 54, which is slideable on a friction gasket 55 located in the area of the conveyor cylinder opening.

Figure 2:
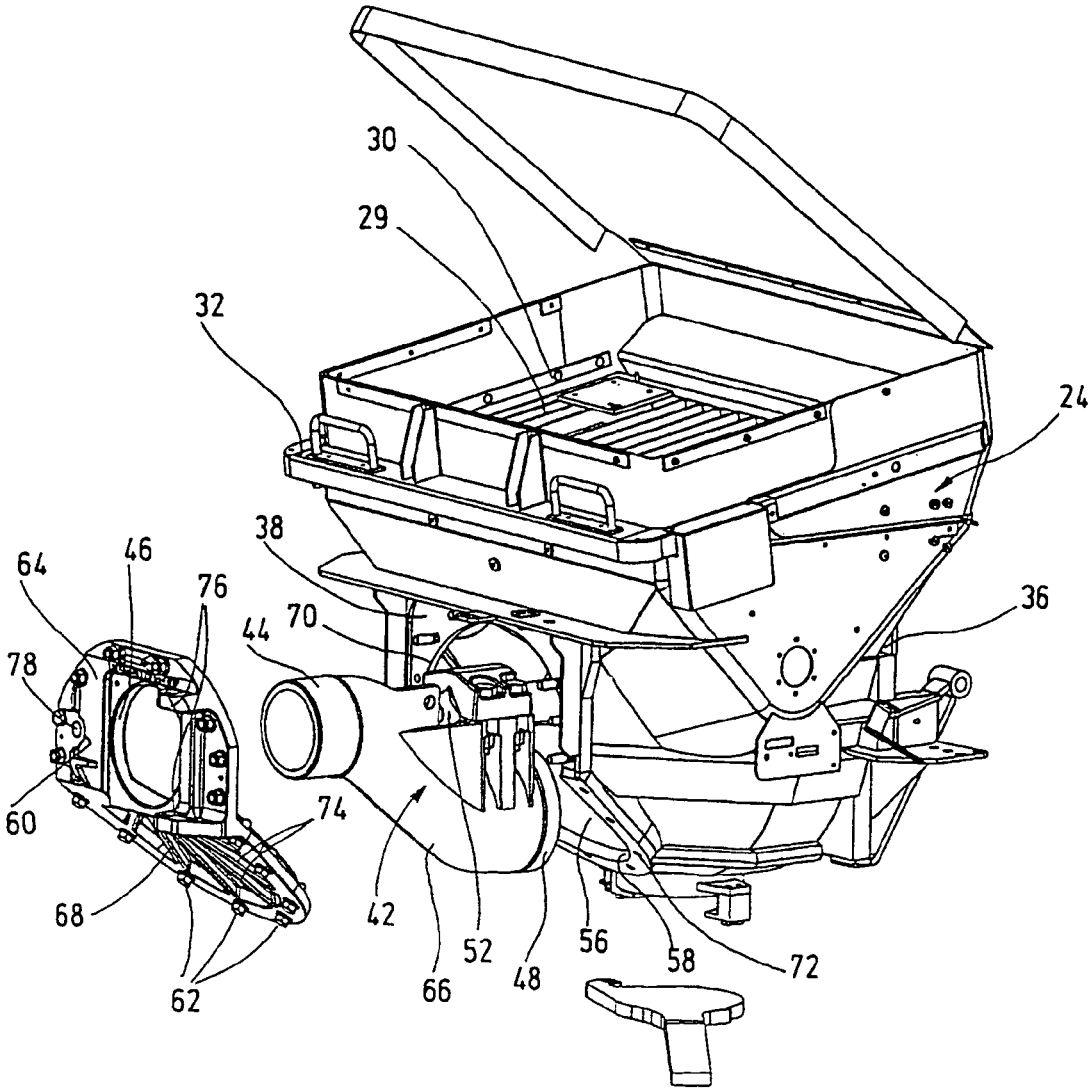
FIG. 2 the material supply container according to FIG. 1 in prospective exploded representation.
Figure 3:
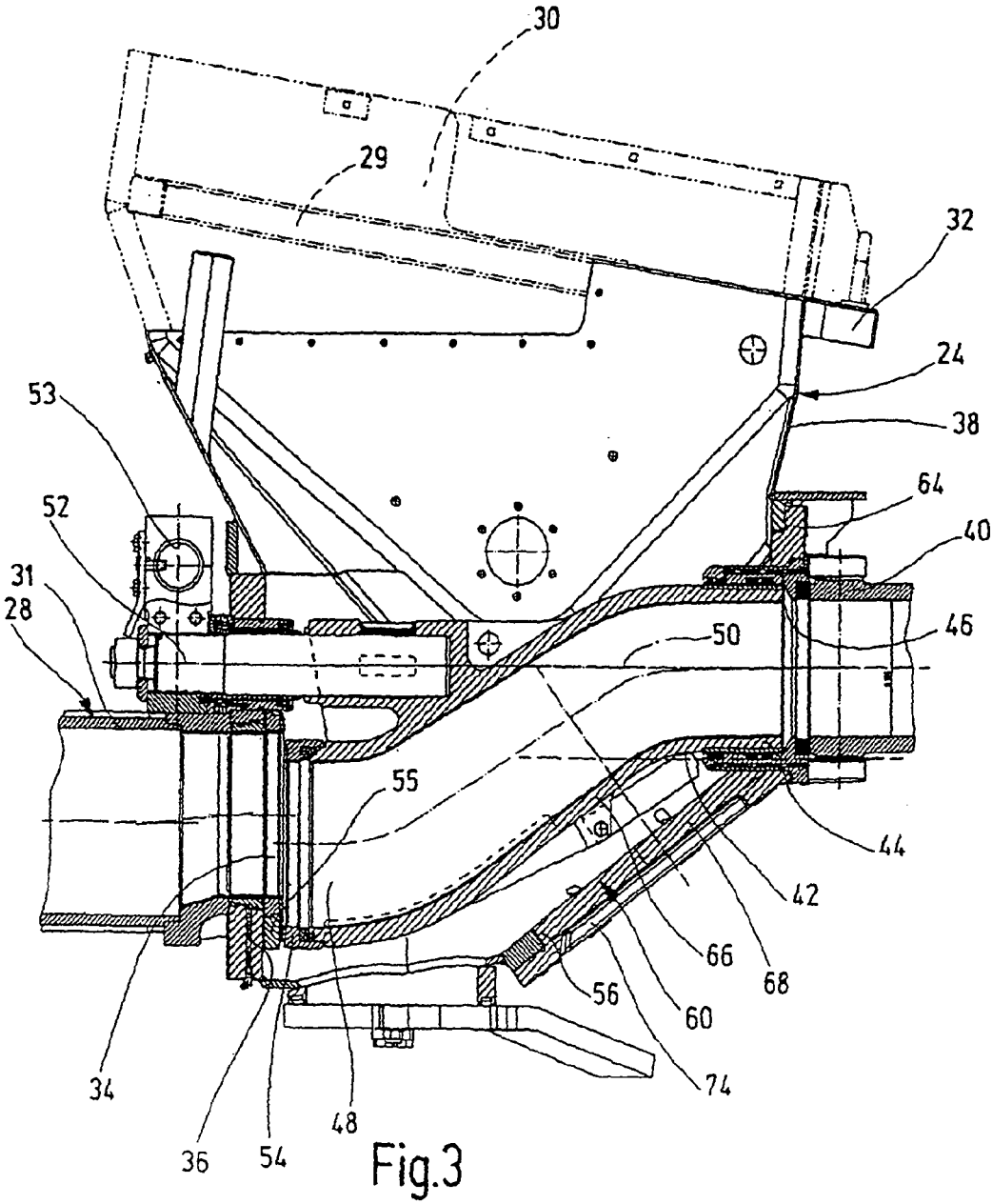
FIG. 3 a side view of the material supply container with sealing cover in partial sectional representation.
Figure 4:
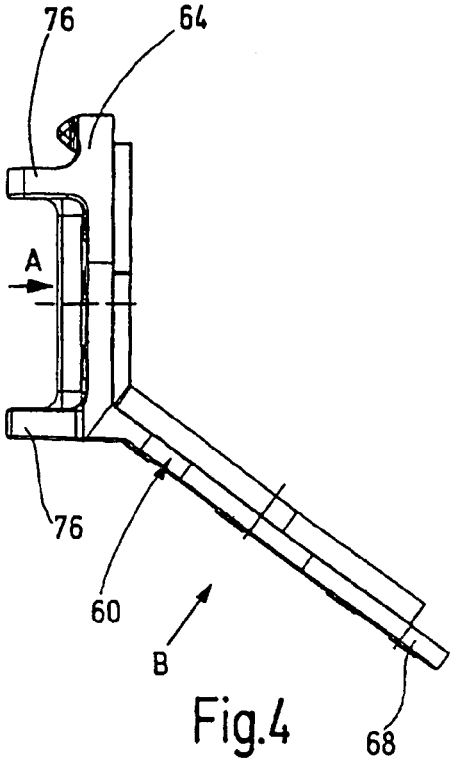
FIG. 4 a side view of the sealing cover according to FIG. 3.
Figure 5A:
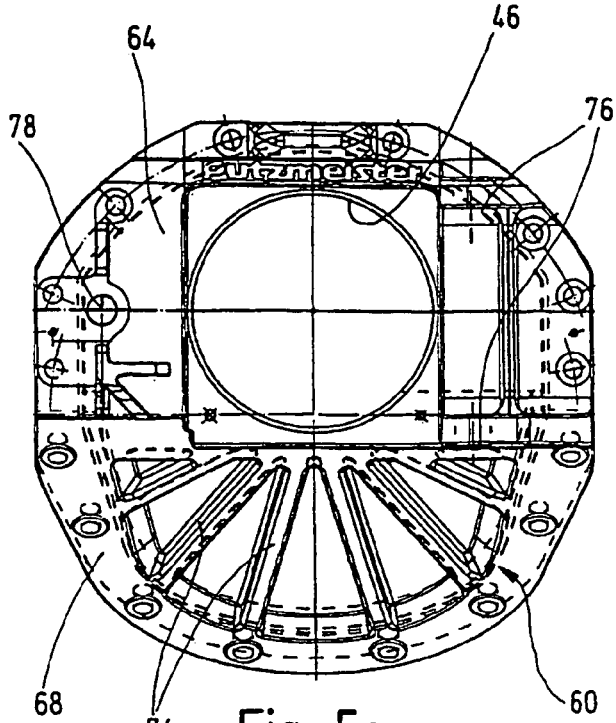
FIGS. 5*a* and *b* each an external view of the sealing cover viewed in the direction of the arrows A and B in FIG. 5.
Figure 5B:
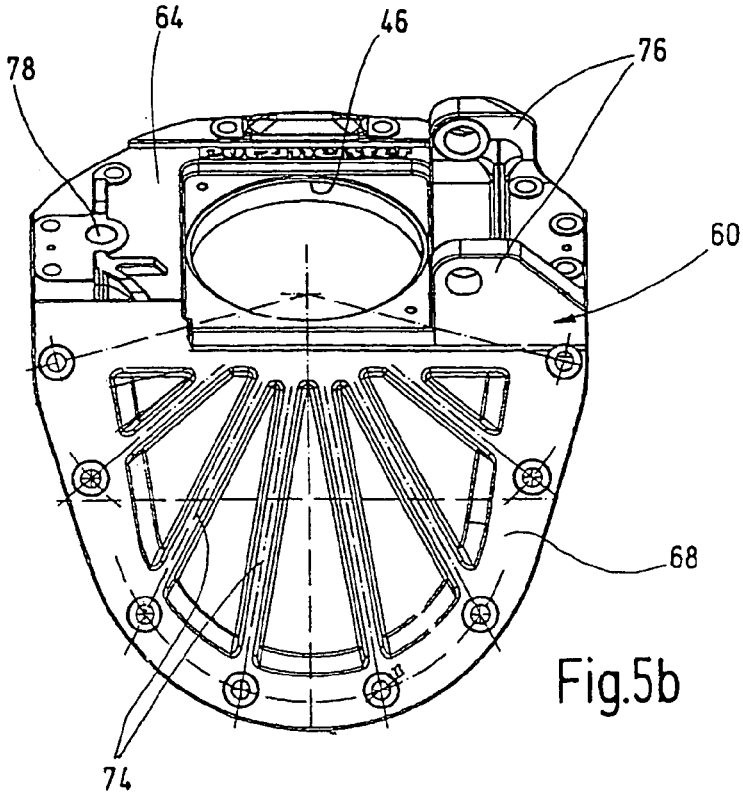

In the rear wall 38 of the material supply container there is a service and assembly opening 56 for the S-pipe 42. The service opening 56 includes a circumferential edge 58, to which a cover plate 60 is securable via flange screws 62. As can be seen particularly from FIG. 2, the service opening 56 is formed by an opening in the rear wall 38. The cover plate 60 includes an upper cover plate part 64 oriented perpendicular to the pivot axis 50 of the S-pipe 42 and containing a through-feed hole 46 for the S-pipe 42 and, connecting to it from below, a lower cover plate part 68 forming a diagonal base part extending essential parallel to the diagonal pipe segment 66. According thereto, the circumferential edge 58 of the service opening 56 exhibits an upper flange part 70 for receiving the upper cover plate part 64, which runs along a plane oriented perpendicular to the pivot axis 50, to the bottom of which is joined a lower flange part 72 for flange-coupling with the lower cover plate part 68, which extends along a plane oriented essentially parallel to the diagonal S-pipe segment 66. The lower cover plate part 68 is provided externally with reinforcing ribs 74 radiating out in the direction of the flange screws 62, which ensure that the forces acting during pre-pivoting of the diagonal pipe segment 66 through the concrete located in the material supply container 24 can be taken up without causing deformation.

For securing the pressure pipe 40, securing elements are provided on the outside of the upper cover plate part 64 sideways beside the through hole 46, which on the one side are mounting lobes or lugs or retaining rings or tabs 76 of a pivot mount with vertical pivot axis, and on the other side is a screw bore 78 for fixing the pressure pipe 40 when pivoted into position in front of the through-feed hole 46.

In summary the following can be concluded: The invention relates to a material feeding container for two-cylinder thick matter pumps. The material feeding container 24 has a material supply opening 30 oriented upward, two feed cylinder openings 34 arranged in the front wall 36 of the container and a transfer tube having the shape of an S-tube 42, which is arranged inside the container with its input end 48 swiveling in an alternating manner in front of the feed cylinder openings 34 and mounted on the output side in a feed-through opening 46 of the rear wall 38 of the container above the feed cylinder openings. A pressure pipe 40 is connected to the outer side of the rear wall 38 of the container, the output side 44 of the S-pipe 42 leading into said pressure pipe. According to the invention, a maintenance opening 56 is arranged on the rear wall 38, which is formed by an opening defined by a peripheral edge 58. The maintenance opening 56 can be closed with a cover plate 60, which has a top cover part 64 that is oriented perpendicular to the swivel axis 50 of the S-pipe 42 and includes the feed-through opening 46 for the S-pipe 42, and a bottom cover plate part 68 that forms an inclined bottom part that is connected to said top part substantially parallel to an S-pipe segment 66 extending obliquely downward.

The invention claimed is:

1. A material feeding container for two-cylinder thick matter pumps, with an upwardly oriented material input opening (30), two feed cylinder openings (34) arranged in the front wall (36) of the container, and a transfer tube having the shape of an S-tube (42), which is arranged inside the container with its input end (48) swiveling in an alternating manner in front of the feed cylinder openings (34) and mounted on the output side in a feed-through opening (46) of the rear wall (38) of the container that is arranged above the feed cylinder openings and in communication with a pressure pipe (40) is connected to the outer side of the rear wall (38) of the container, the output side (44) of the S-pipe (42) communicating with said pressure pipe, thereby characterized, that a maintenance opening (56) is arranged on the rear wall (38), which is formed by an opening defined by a peripheral edge (58), that the maintenance opening (56) can be closed with a cover plate (60), which has a top cover plate part (64) that is oriented perpendicular to the swiveling axis (50) of the S-pipe (42) and includes the feed-through opening (46) for the S-pipe (42) and a bottom cover plate part (68) that forms an inclined bottom part and that is connected to said top part substantially parallel to an S-pipe segment (66) extending obliquely downward.

2. The material feeding container according to claim 1, wherein the peripheral edge (58) of the service opening includes an upper flange part (70) for flange connecting to the upper cover plate part (64), which is oriented in a plane perpendicular to the pivot axis (50) of the S-pipe (42) and which joins below a lower flange part (72) for flange connection to the lower cover plate part (68), which is oriented in a plane substantially parallel to the diagonally extending S-pipe segment (66).

3. The material feeding container according to claim 1, wherein on the outer side of the upper cover plate part (64), towards the side besides the through-feed opening (42) elements are provided for the releasable attachment of the pressure pipe (40).

4. The material feeding container according to claim 3, wherein a part of the securing element is a pivot mount (76), on which the pressure pipe (40) is able to pivot relative to the through-feed opening (46) about a vertical axis.

5. The material feeding container according to claim 4, wherein one of the securing elements is a screw-hole (78) or a securing bolt for securing the pressure pipe (40) when pivoted into place in front of the through-feed opening (46).

6. The material feeding container according to claim 1, wherein reinforcing ribs (80) radiating in the direction of the cover edge are provided on the outside of the lower cover plate (68).

* * * * *